US007536808B2

(12) United States Patent
Myers et al.

(10) Patent No.: US 7,536,808 B2
(45) Date of Patent: May 26, 2009

(54) BREATHABLE SOLE STRUCTURES AND PRODUCTS CONTAINING SUCH SOLE STRUCTURES

(75) Inventors: Craig Myers, Oregon City, OR (US); Bo Lupo, Portland, OR (US)

(73) Assignee: Nike, Inc., Beaverton, OR (US)

( * ) Notice: Subject to any disclaimer, the term of this patent is extended or adjusted under 35 U.S.C. 154(b) by 448 days.

(21) Appl. No.: 11/340,672

(22) Filed: Jan. 27, 2006

(65) Prior Publication Data

US 2006/0168847 A1 Aug. 3, 2006

Related U.S. Application Data

(60) Provisional application No. 60/648,375, filed on Jan. 31, 2005.

(51) Int. Cl.
*A43B 7/06* (2006.01)

(52) U.S. Cl. ..... 36/3 B

(58) Field of Classification Search ..... 36/3 B, 36/29, 3 R, 25 R, 3 A
See application file for complete search history.

(56) References Cited

U.S. PATENT DOCUMENTS

| | | | |
|---|---|---|---|
| 30,391 | A | 10/1860 | Dexter |
| 379,579 | A | 3/1888 | Jensen |
| 418,966 | A | 1/1890 | Welander |
| 429,429 | A | 6/1890 | Eckhardt |
| 452,655 | A | 5/1891 | Valiant |
| 485,180 | A | 11/1892 | Eastman |
| 578,794 | A | 3/1897 | Warner |
| 660,522 | A | 10/1900 | Sharood |
| 746,862 | A | 12/1903 | Matson |
| 853,336 | A | 5/1907 | Ball |
| 896,488 | A | 8/1908 | Valiant |
| 940,856 | A | 11/1909 | Critz, Jr. |
| 1,029,110 | A | 6/1912 | Drobinski |
| 1,540,430 | A | 6/1925 | Sims |
| 1,696,457 | A | 12/1928 | Shanahan |
| 1,932,557 | A | 10/1933 | Meucci |
| 1,974,456 | A | 9/1934 | Goldzweig |
| 1,981,300 | A | 11/1934 | Berg |
| 2,098,412 | A | 11/1937 | Bovay |
| 2,153,304 | A | 4/1939 | Gruber |
| 2,200,849 | A | 5/1940 | Margolin |
| 2,344,762 | A | 3/1944 | Wylie |
| 2,358,342 | A | 9/1944 | Margolin |
| 2,437,065 | A | 3/1948 | Austin |

(Continued)

FOREIGN PATENT DOCUMENTS

| | | |
|---|---|---|
| BE | 1011574 | 11/1999 |

(Continued)

*Primary Examiner*—Ted Kavanaugh
(74) *Attorney, Agent, or Firm*—Banner & Witcoff, Ltd

(57) ABSTRACT

Sole structures for footwear are constructed to provide excellent air exchange, ventilation, and breathability. Sole plates used in these sole structures may include plural rib elements extending across the sole to define plural slat openings in the sole plate. By providing these slat openings adjacent openings in the midsole member, excellent gas flow communication to/from the footwear interior may be provided. Slat vented sole plates and sole structures containing such sole plates may be included in articles of footwear or other foot-receiving devices, and advantageously in athletic footwear and other articles of footwear in which venting and breathability are important.

21 Claims, 9 Drawing Sheets

U.S. PATENT DOCUMENTS

| | | | |
|---|---|---|---|
| 2,457,944 | A | 1/1949 | Vlastos |
| 2,474,815 | A | 7/1949 | Brahm |
| 2,558,973 | A | 7/1951 | Meaker |
| 2,720,041 | A | 10/1955 | Kajtar |
| 2,751,692 | A | 6/1956 | Cortina |
| 2,884,716 | A | 5/1959 | Shelare et al. |
| 3,061,950 | A | 11/1962 | Levine |
| 3,256,621 | A | 6/1966 | Linton |
| 4,000,566 | A | 1/1977 | Famolare, Jr. |
| 4,063,371 | A | 12/1977 | Batra |
| 4,078,321 | A | 3/1978 | Famolare, Jr. |
| 4,100,685 | A | 7/1978 | Dassler |
| 4,102,061 | A | 7/1978 | Saaristo |
| 4,112,599 | A | 9/1978 | Krippelz |
| 4,215,492 | A | 8/1980 | Sandmeier |
| 4,290,211 | A | 9/1981 | Csengeri |
| 4,430,811 | A | 2/1984 | Okada |
| 4,438,573 | A | 3/1984 | McBarron |
| 4,499,672 | A | 2/1985 | Kim |
| 4,507,880 | A | 4/1985 | Ohashi |
| 4,571,853 | A | 2/1986 | Medrano |
| 4,654,982 | A | 4/1987 | Lee |
| 4,663,865 | A | 5/1987 | Telecemian |
| 4,736,531 | A | 4/1988 | Richard |
| 4,739,765 | A | 4/1988 | Sydor et al. |
| 4,825,565 | A | 5/1989 | Bigolin |
| 4,837,948 | A | 6/1989 | Cho |
| 4,860,463 | A | 8/1989 | Pin |
| 4,979,317 | A | 12/1990 | Fukuoka |
| 5,044,096 | A | 9/1991 | Polegato |
| 5,086,576 | A | 2/1992 | Lamson |
| 5,224,277 | A | 7/1993 | Sang Do |
| 5,319,866 | A | 6/1994 | Foley et al. |
| 5,357,689 | A | 10/1994 | Awai |
| 5,511,323 | A | 4/1996 | Dahlgren |
| 5,588,226 | A | 12/1996 | Schenkel |
| 5,598,644 | A | 2/1997 | Polegato |
| 5,647,150 | A | 7/1997 | Romanato et al. |
| 5,655,314 | A | 8/1997 | Petracci |
| 5,675,914 | A | 10/1997 | Cintron |
| 5,678,329 | A | 10/1997 | Griffin et al. |
| 5,746,012 | A | 5/1998 | Caletti et al. |
| 5,797,610 | A | 8/1998 | Grande et al. |
| 5,915,820 | A | 6/1999 | Kraeuter et al. |
| 5,983,524 | A | 11/1999 | Polegato |
| 5,983,525 | A | 11/1999 | Brown |
| 5,992,052 | A | 11/1999 | Moretti |
| 6,041,518 | A | 3/2000 | Polycarpe |
| 6,119,373 | A | 9/2000 | Gebhard et al. |
| 6,237,251 | B1 | 5/2001 | Litchfield et al. |
| 6,256,824 | B1 | 7/2001 | Austin et al. |
| 6,305,100 | B1 | 10/2001 | Komarnycky et al. |
| 6,389,711 | B1 | 5/2002 | Polegato |
| 6,655,048 | B2 | 12/2003 | Moretti |
| 6,681,500 | B2 | 1/2004 | Moretti |
| 6,817,112 | B2 | 11/2004 | Berger et al. |
| D511,879 | S * | 11/2005 | Caine ..... D2/908 |
| 7,178,266 | B2 * | 2/2007 | Deem et al. ..... 36/3 B |
| 7,210,248 | B2 * | 5/2007 | Van Noy et al. ..... 36/3 R |
| 2002/0017036 | A1 * | 2/2002 | Berger et al. ..... 36/3 B |
| 2002/0157278 | A1 | 10/2002 | Moretti |
| 2006/0162183 | A1 * | 7/2006 | Polegato Moretti ..... 36/3 B |

FOREIGN PATENT DOCUMENTS

| | | |
|---|---|---|
| CH | 418179 | 7/1966 |
| DE | 600894 | 8/1934 |
| DE | 800364 | 11/1950 |
| DE | 4333597 | 7/1994 |
| EP | 0130816 | 1/1985 |
| EP | 0471447 | 2/1992 |
| EP | 0960579 | 12/1999 |
| EP | 1197157 | 4/2002 |
| GB | 2247391 | 3/1992 |
| JP | 03236801 | 10/1991 |
| JP | 06141906 | 5/1994 |
| JP | 07327706 | 12/1995 |
| JP | 8056704 | 3/1996 |
| JP | 08089307 | 4/1996 |
| JP | 08112104 | 5/1996 |
| JP | 9248203 | 9/1997 |
| JP | 10014605 | 1/1998 |
| JP | 10234414 | 9/1998 |
| JP | 10248609 | 9/1998 |
| JP | 11018805 | 1/1999 |
| JP | 11042103 | 2/1999 |
| JP | 2000175701 | 6/2000 |
| JP | 2001029110 | 2/2001 |
| WO | 9851177 | 11/1998 |

* cited by examiner

BREATHABLE SOLE STRUCTURES AND PRODUCTS CONTAINING SUCH SOLE STRUCTURES

RELATED APPLICATION DATA

This application claims priority benefits from U.S. Provisional Patent Appln. No. 60/648,375 filed Jan. 31, 2005 in the names of Craig Myers and Bo Lupo. This earlier priority application is entirely incorporated herein by reference.

FIELD OF THE INVENTION

This invention relates generally to sole structures for footwear and/or portions thereof, as well as to footwear products containing such structures. Sole structures in accordance with at least some example aspects of this invention will have excellent air exchange, ventilation, and breathability characteristics.

BACKGROUND

Conventional articles of footwear, including athletic footwear, typically have included two primary elements, namely an upper member and a sole member or structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground (as used herein, the term "ground" includes any type of foot or footwear contact surface, including but not limited to dirt, grass, sand, tile, flooring, carpeting, artificial turf, etc.). In addition to attenuating ground reaction forces, the sole structure may provide traction and help control foot motion, such as pronation. Accordingly, the upper member and the sole structure operate cooperatively to provide a comfortable structure that is suited for a variety of ambulatory activities, such as walking and running.

The sole member or structure of athletic footwear, in at least some instances, will exhibit a layered configuration that includes a comfort-enhancing insole, a resilient midsole (e.g., formed, at least in part, from a polymer foam material), and a ground-contacting outsole that may provide both abrasion-resistance and traction. The midsole, in at least some instances, will be the primary sole structure element that attenuates ground reaction forces and controls foot motion. Suitable polymer foam materials for at least portions of the midsole include ethylvinylacetate ("EVA") or polyurethane ("PU") that compress resiliently under an applied load to attenuate ground reaction forces. Conventional polymer foam materials are resiliently compressible, in part, due to the inclusion of a plurality of open or closed cells that define an inner volume substantially displaced by gas.

To keep a wearer safe and comfortable, footwear is called upon to perform a variety of functions. For example, the sole structure of footwear must provide adequate support and impact force attenuation properties to prevent injury and reduce fatigue, while at the same time provide adequate air exchange and breathability to provide a comfortable housing for prolonged wear under athletic use conditions. Given the multiple requirements for footwear products, it would be useful to provide a sole structure and/or support elements included as part of a sole structure that provide adequate strength and support while still providing a breathable structure that allows for relatively free air exchange between the interior and exterior of the shoe.

SUMMARY

The following presents a general summary of aspects of this invention in order to provide a basic understanding of at least some aspects of the invention.

Aspects of this invention relate to sole structures for footwear that have excellent air exchange, ventilation, and breathability characteristics. A first aspect of the invention relates to sole plates for use in footwear sole structures. Such sole plates may include: (a) a first edge; (b) a second edge opposite the first edge; (c) a third edge extending between the first and second edges; and (d) a fourth edge opposite the third edge and extending between the first and second edges. Plural rib elements may extend in a direction from the third edge toward the fourth edge to thereby define plural slat openings between the adjacent rib elements. In at least some examples, the rib elements (and hence the corresponding slat openings) may extend from a lateral to a medial side of a footwear structure. These slat openings, at least in part, allow gas flow communication between the interior of a footwear structure and the exterior environment. Various other structural features, including the structural features described in more detail below, may be included in the sole plate structures in accordance with at least some examples of this invention.

Sole plates of various structures, including the structures described above, may be incorporated into sole structures for footwear products, such as athletic footwear products. Sole structures in accordance with at least some examples of this invention may include: (a) a midsole member (e.g., made of conventional materials, for example, of resilient materials, as described above), wherein at least an arch portion of the midsole member includes at least a first opening defined therein; (b) a sole plate engaged with the midsole member at the arch portion, wherein the sole plate at least substantially covers the first opening, and wherein the sole plate includes plural rib elements extending in substantially a transverse direction of the sole structure to thereby define plural slat openings in the sole plate that extend between adjacent rib elements; and (c) at least a first outsole member engaged with the midsole member for providing a ground-contacting surface. In at least some examples of the invention, the sole plate may have the structure described above. Various other structural features, including the structural features described in more detail below, may be included in sole structures in accordance with this invention.

Still additional aspects of this invention relate to articles of footwear that incorporate the sole plates and/or sole structures described above, or at least some aspects of the sole plates and/or sole structures described above. Such articles of footwear may include: (a) an upper member; and (b) a sole structure engaged with the upper member. In at least some examples, the sole structure in such articles of footwear may include: (i) a midsole member, wherein at least an arch portion of the midsole member includes a first opening defined therein; (ii) a sole plate engaged with the midsole member at the arch portion, wherein the sole plate at least substantially covers the first opening, and wherein the sole plate includes plural rib elements extending in substantially a transverse direction of the sole structure to thereby define plural slat openings in the sole plate that extend between adjacent rib elements; and (iii) a first outsole member engaged with the midsole member for providing a ground-contacting surface. Various other structural features, including the structural features described in more detail below, may be included in footwear structures in accordance with examples of this invention.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

DETAILED DESCRIPTION

Figure 1:
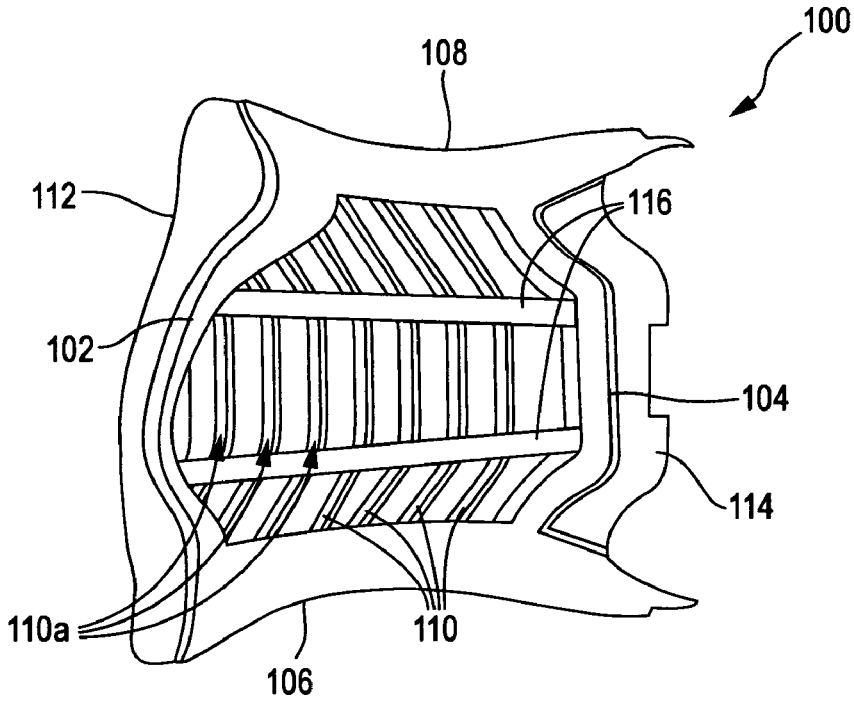
FIG. 1 illustrates an interior or "foot-side" view of a sole plate in accordance with and/or useful in at least some examples of this invention.

In the following description of various examples of the invention, reference is made to the accompanying drawings, which form a part hereof, and in which are shown by way of illustration various example systems and environments in which aspects of the invention may be practiced. It is to be understood that other specific arrangements of parts, example systems, and environments may be utilized and structural and functional modifications may be made to the specific structures described herein without departing from the scope of the present invention. Also, while the terms "top," "bottom," "side," "front," "back," "above," "below," "under," "over," and the like may be used in this specification to describe various example features and elements of the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows: Terms; General Description of Sole Structures, Portions Thereof, and Footwear Products According to the Invention; Specific Examples of the Invention; and Conclusion.

A. Terms

The following terms may be used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Ground-contacting elements" or "members" include at least some portions of a foot-receiving device structure that contact the ground (or other surface, as described above) in use, and/or at least some portions of a foot-receiving device structure that engage another element or structure in use. Such "ground-contacting elements" may include, for example, but are not limited to, outsole elements or portions thereof provided in some conventional footwear products. "Ground-contacting elements" in at least some example structures may be made of suitable and conventional materials to provide long wear and protect the foot and/or to prevent the remainder of the foot-receiving device structure from wear effects, e.g., when contacting the ground or other surface in use.

B. General Description of Sole Structures, Portions Thereof, and Footwear Products According to the Invention In general, aspects of this invention relate to sole structures and portions thereof for footwear. The final sole structures and/or footwear products may have excellent air exchange, ventilation, and breathability characteristics. Aspects of the invention will be described in more detail below.

1. Sole Plates

One aspect of the invention relates to sole plates for use in footwear sole structures and/or foot-supporting members for other foot-receiving devices. Such sole plates may include: (a) a first edge; (b) a second edge opposite the first edge; (c) a third edge extending between the first and second edges; and (d) a fourth edge opposite the third edge and extending between the first and second edges. Plural rib elements may extend in a direction from the third edge toward the fourth edge to thereby define plural slat openings between the adjacent rib elements. In at least some examples, the rib elements (and hence the corresponding slat openings) may extend from a lateral side to a medial side of a footwear structure. These slat openings allow gas flow communication between the interior of the footwear structure and the exterior environment, as will be described in more detail below. Any desired number of rib elements and corresponding slat openings may be provided in a sole plate structure without departing from the invention.

Additional structural elements also may be included as part of a sole plate structure, e.g., to allow its incorporation into the remainder of a sole structure. For example, a sole plate structure in accordance with at least some examples of this invention may include a first engagement flange extending from the first edge of the sole plate and away from its second edge (e.g., toward the forefoot portion of a shoe when included in a shoe) and a second engagement flange extending from the second edge of the sole plate and away from its first edge (e.g., toward a rearfoot portion of a shoe when included in a shoe). These engagement flanges may engage other elements of a footwear structure, such as portions of an outsole member, a midsole member, a fluid-filled (e.g., air or other gas filled) bladder, or the like.

Sole plates in accordance with at least some examples of this invention may include further elements that improve their rigidity and structural integrity. As an example, a sole plate in accordance with at least some examples of this invention may include at least one reinforcing rib extending between at least some of the plural rib elements (and thereby across at least some of the plural slat openings). In at least some structures, the reinforcing rib(s) may extend generally in a longitudinal direction of an article of footwear (e.g., generally in a direction from a forefoot portion of the shoe toward a rearfoot portion of the shoe). Of course, any number of reinforcing ribs may be provided without departing from this invention, and each reinforcing rib may extend across any desired number of the plural ribs and corresponding slat openings without departing from this invention.

2. Sole Structures

Additional aspects of this invention relate to sole structures for footwear products, such as athletic footwear products. Such sole structures may include: (a) a midsole member (e.g., made of conventional materials, for example, of resilient materials, as described above), wherein at least an arch portion of the midsole member includes at least a first opening defined therein; (b) a sole plate engaged with the midsole member at the arch portion, wherein the sole plate at least substantially covers the first opening, and wherein the sole plate includes plural rib elements extending in substantially a transverse direction of the sole structure to thereby define plural slat openings in the sole plate that extend between adjacent rib elements; and (c) at least a first outsole member engaged with the midsole member for providing a ground-contacting surface. In at least some examples of the invention, the sole plate may have the structure described in more detail above.

The opening(s) in the arch portion of the midsole member, in at least some examples of this invention, may be significantly sized, to thereby allow a substantial opening for gas exchange with the exterior of the shoe structure. At least some of the openings in the arch portion of the midsole member may extend uninterrupted in substantially a longitudinal direction of the sole structure (i.e., in a direction from a toe portion of the sole structure toward a heel portion of the sole structure) for at least one inch, and in some examples, up to two inches or potentially even more (e.g., depending, at least in part, on the overall shoe size). If desired, a breathable membrane (e.g., made from GORE-TEX®, commercially available from W.L. Gore & Associates, or SYMPATEX®, commercially available from Sympatex Technologies GmbH of Wuppertal, Germany) may be provided at least partially over the opening(s) in the arch portion of the midsole member to reduce direct moisture access to the interior of the footwear structure while still providing gas release from the interior of the footwear structure.

Additional openings also may be provided in the midsole member to further improve and assist in air exchange between the interior sole structure and the external environment. For example, a forefoot portion of the midsole member may include one or more openings defined therein, optionally opening(s) that are independent of the opening(s) defined in the arch portion (described above). Also, if desired, a breathable membrane (e.g., made from GORE-TEX®, commercially available from W.L. Gore & Associates, or SYMPATEX®, commercially available from Sympatex Technologies GmbH of Wuppertal, Germany) may be provided over the opening(s) in the forefoot portion of the midsole member to reduce moisture access to the interior of the footwear structure while still providing gas release from the interior of the footwear structure.

In at least some example sole structures in accordance with this invention, the sole structure further may include at least one outsole member is engaged with the midsole member. If desired, independent outsole members may be provided at different portions of the sole structure. In one more specific example, an outsole member may be engaged with the midsole member at least at a forefoot portion of the sole structure. Additionally, if desired, in at least some examples, this outsole member may include at least one opening defined therein corresponding to a location of the opening(s) in the forefoot portion of the midsole member (if any). Alternatively, if desired, this outsole member may at least partially cover the opening(s) in the forefoot portion of the midsole member (and air exchange with the exterior via these openings may occur in another manner, such as through the side of the sole structure, through another portion of the outsole member, between outsole members, between an outsole member and the midsole member, etc.). Additional outsole members may be provided in other areas of the sole structure, such as in the heel, rearfoot, midfoot, arch, or other portions of the sole structure. As an additional example, if desired, a single outsole member may be provided that covers one or more of the toe, forefoot, heel, rearfoot, midfoot, arch, and/or other portions of the sole structure.

Other structural features may be included as part of the sole structure without departing from this invention. For example, the sole structure may include a fluid-filled bladder element (e.g., for impact-attenuation) between the midsole member and an outsole member. One or more fluid-filled bladders may be provided in any portion of the sole structure, such as in a heel area or rearfoot portion of a sole structure, in a midfoot portion of the sole structure, in a toe or forefoot portion of the sole structure, etc.

3. Articles of Footwear or Other Foot-Receiving Devices

Additional aspects of this invention relate to articles of footwear (or other foot-receiving devices) that incorporate the sole plates and/or sole structures described above, or incorporate sole plates and/or sole structures including at least some of the various aspects described above. Such articles of footwear (or other foot-receiving devices) may include: (a) an upper member (or other foot-covering member); and (b) a sole structure (or other foot-supporting member) engaged with the upper member. In at least some examples, the sole structure in such articles of footwear may include: (i) a midsole member, wherein at least an arch portion of the midsole member includes a first opening defined therein; and (ii) a sole plate engaged with the midsole member at the arch portion, wherein the sole plate at least substantially covers the first opening, and wherein the sole plate includes plural rib elements extending in substantially a transverse direction of the sole structure to thereby define plural slat openings in the sole plate that extend between adjacent rib elements. The sole structure (or other foot-supporting member) of the article of footwear (or other foot-receiving device) further may include a first outsole member (or other ground-contacting member) engaged with the midsole member for providing a ground-contacting surface.

Other example articles of footwear (or other foot-receiving devices) in accordance with aspects of this invention may include: (a) an upper member (or other foot-covering member); and (b) a sole structure (or other foot-supporting member) engaged with the upper member, wherein the sole structure includes: (i) a midsole member, wherein at least an arch portion of the midsole member includes a first opening and a second opening defined therein, wherein each of the first and second openings extends uninterrupted in a longitudinal direction of the sole structure for at least one inch; and (ii) a sole plate engaged with the midsole member at the arch portion, wherein the sole plate at least substantially covers the first and second openings, and wherein the sole plate includes plural rib elements extending in substantially a transverse direction of the sole structure to thereby define plural slat openings in the sole plate that extend between adjacent rib elements. The sole structure (or other foot-supporting member) of the article of footwear (or other foot-receiving device) further may include a first outsole member (or other ground-contacting member) engaged with the midsole member at a forefoot portion of the sole structure and a second outsole member (or other ground-contacting member) engaged with the midsole member at a rearfoot portion of the sole structure.

As noted above, the sole plate and/or the sole structures in the articles of footwear (or other foot-receiving devices) may have the various structural features and/or characteristics described above without departing from this invention.

Specific examples and structures according to the invention are described in more detail below. The reader should understand that these specific examples and structures are set forth merely to illustrate the invention, and they should not be construed as limiting the invention.

C. Specific Examples of the Invention

The various figures in this application illustrate examples of sole plates and/or sole structures, as well as their arrangement in foot-receiving device products according to examples of this invention. When the same reference number appears in more than one drawing, that reference number is used consistently in this specification and the drawings to refer to the same or similar parts throughout.

Figure 2:
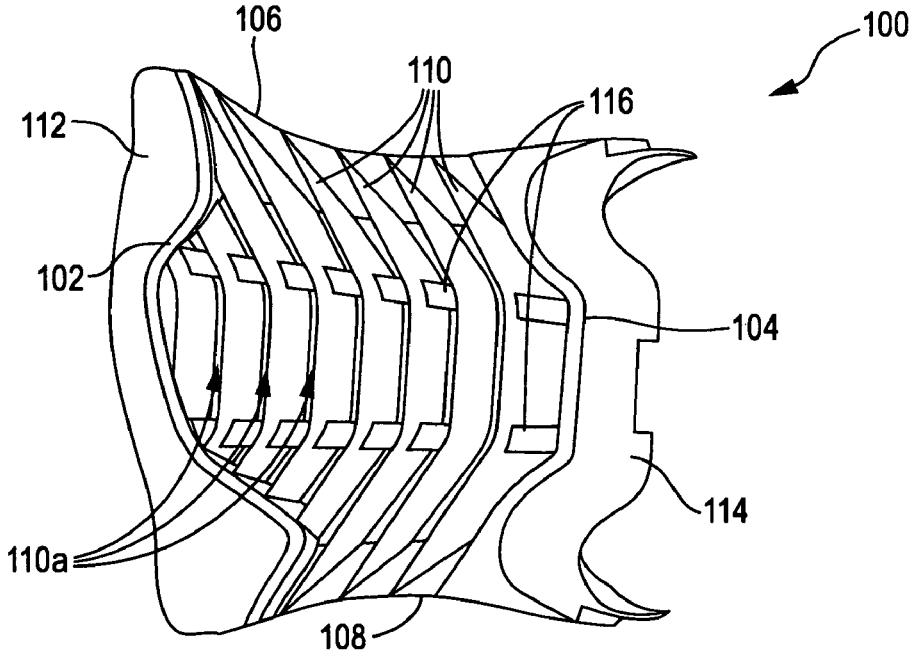
FIG. 2 illustrates an exterior side view of a sole plate in accordance with and/or useful in at least some examples of this invention.

FIGS. 1 and 2 illustrate the interior and exterior sides of an example sole plate member 100 that may be used in footwear products (or other foot-receiving device products) in accordance with at least some examples of this invention. As shown in these figures, the sole plate 100 includes a first or forward edge 102 and a second or rearward edge 104 opposite the first edge 102. The sole plate 100 further includes a third or medial edge 106 and a fourth or lateral edge 108 that each extends between the first edge 102 and the second edge 104. The third edge 106 and fourth edge 108 lie opposite one another in the sole plate structure 100, as shown in FIGS. 1 and 2. As also shown in FIGS. 1 and 2, the various "edges" of the sole plate structure 100 need not define and/or lie in a straight line, but they may be straight, curved, segmented, or otherwise non-regularly shaped without departing from this invention. Moreover, as shown in FIGS. 1 and 2, although not necessary, the various edges 102, 104, 106, and 108 may have different shapes from one another, if desired.

The sole plate structure 100 of FIGS. 1 and 2 further includes plural rib elements 110 that extend generally in a direction from the third edge 106 toward the fourth edge 108 of the sole plate structure 100 (which, in at least some examples, will correspond to substantially a transverse direction across the sole structure and/or across the shoe structure when the sole plate 100 finally is assembled into a sole structure). Between adjacent rib elements 110, the sole plate structure 100 of this example remains open to thereby define plural slat openings **110*a* in the sole plate structure 100. The combined rib 110 and open slat 110*a* structure provides a strong sole plate structure 100 (and thereby a strong support element structure for an article of footwear) while still allowing free exchange of air between the interior and exterior of the shoe structure, to thereby provide a comfortable and breathable footwear product, as will be described in more detail below. As illustrated in FIGS. 1 and 2, the rib elements 110 need not lie in straight lines that extend all the way across the sole plate 100. Rather, the rib elements 110 may be straight, curved, segmented, or otherwise non-regularly shaped without departing from this invention. Also, not all the rib elements 110 need to have the same exact size or shape and/or extend in the same exact manner and/or in a parallel manner to one another. Rather, if desired, variations in the sizes, shapes, arrangement, and/or orientation of the rib elements 110 may be provided within a single sole plate structure 100** without departing from this invention.

Additional features of the sole plate structure 100 may be provided to help it securely fit within a footwear structure. One such feature relates to engagement flanges that may be included in the sole plate structure 100. As shown in FIGS. 1 and 2, a first (or forefoot) engagement flange 112 extends from the first edge 102 and away from the second edge 104. Additionally, in at least some example sole plate structures 100, a second (or rearfoot) engagement flange 114 may be provided that extends from the second edge 104 and away from the first edge 102. These engagement flanges 112 and 114 may be provided as retaining edges or elements that engage with other portions of the footwear sole structure, as will be described below. Of course, any number of engagement flanges may be provided along the various edges of a sole plate structure 100 without departing from the invention. For example, the third and fourth edges 106 and 108 also may include engagement flanges, if necessary or desired, without departing from the invention. Also, while the illustrated example shows a single engagement flange 112 and 114 extending across its respective edge 102 and 104, respectively, if desired, two or more engagement flanges may be provided along a single edge without departing from this invention.

The sole plate structure 100 further may include one or more reinforcing ribs 116 that extend between at least some of the plural rib elements 110 (and thereby extend across at least some of the plural slat openings 110*a*). Of course, any number of reinforcing ribs 116 may be included in the sole plate structure 100 without departing from the invention, including zero. In the illustrated example, two reinforcing ribs 116 are shown.

Additionally, while the illustrated example shows each reinforcing rib 116 extending across or substantially all the way across the sole plate structure 100 (e.g., essentially all of the way from the first edge 102 to the second edge 104), the various individual ribs 116 may be made from plural individual rib portions, if desired, and/or the various individual ribs 116 may extend across only a portion of the sole plate structure 100, if desired, without departing from this invention.

The sole plate 100 may be made in many different ways, from many different materials, and in many different structures without departing from this invention, including in conventional ways and from materials conventionally used in base plates for sole structures and/or other portions of footwear products. In at least some examples of this invention, the sole plate 100 will be constructed from strong, rigid materials under typical footwear use conditions, such as metals, polymers, or the like. A sole plate 100 in accordance with at least some examples of this invention may be constructed from thermosetting or thermoplastic polymeric materials, e.g., by a molding process (such as by injection or blow molding processes), such as from PEBAX® materials (a polyether-block co-polyamide polymer available from Atofina Corporation of Puteaux, France) or other suitable materials. If desired, the sole plate 100, including all or at least some of the edges 102, 104, 106, and 108, the rib elements 110, the flanges 112 and 114, and/or the reinforcing ribs 116, may be made as a single, unitary, one-piece construction, e.g., from PEBAX® materials (a polyether-block co-polyamide polymer available from Atofina Corporation of Puteaux, France) or other polymeric materials (such as thermoplastic or thermosetting materials) by a molding process (such as by injection or blow molding processes). Alternatively or optionally, if desired, the sole plate 100 may be made from multiple independent pieces of material in at least some examples of this invention.

Figure 3:
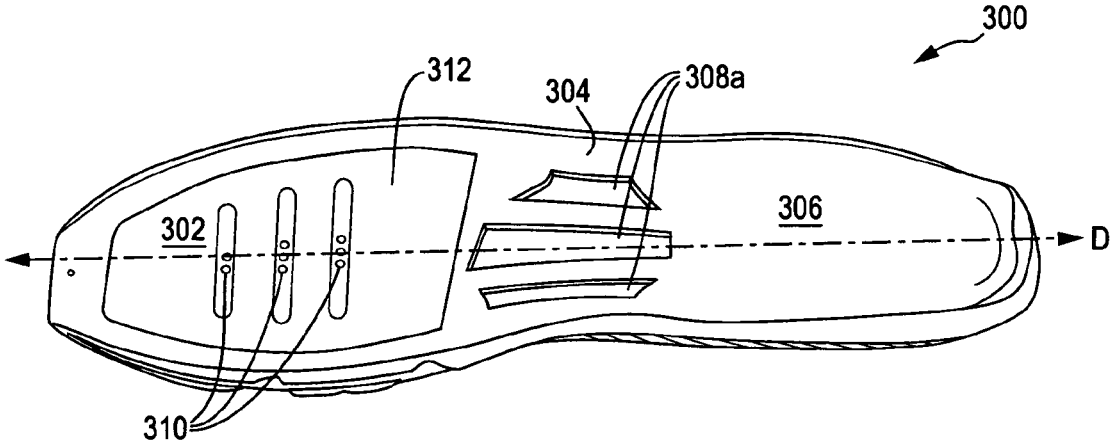
FIG. 3 illustrates an interior or "foot-side" view of a midsole member useful in sole structures in accordance with at least some examples of this invention.
Figure 4:
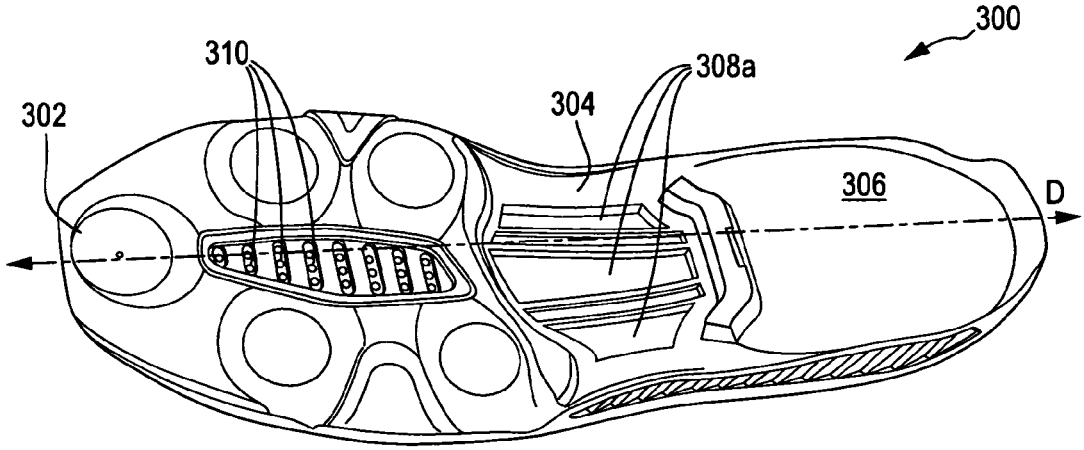
FIG. 4 illustrates an exterior side view of a midsole member useful in sole structures in accordance with at least some examples of this invention.

FIGS. 3 and 4 illustrate an example of another portion of a sole structure for an article of footwear (e.g., athletic footwear), namely, an example midsole member 300. This midsole member 300, which may be used in accordance with examples the invention, is one of the primary sole structure elements that attenuates ground reaction forces. This midsole member 300 may be constructed from polymer foam materials, as is conventional and known in the art, for example, from ethylvinylacetate or polyurethane materials or other materials that compress resiliently under an applied load to attenuate ground reaction forces. Of course, the midsole member 300 may be made in any desired manner without departing from the invention, including conventional manners known and used in the art, such as by molding processes or the like.

The midsole member 300 may include a forefoot portion 302, an arch portion 304, and a rearfoot portion 306 that correspond to various areas of a wearer's foot. As shown in FIGS. 3 and 4, in this example midsole member structure 300, at least the arch portion 304 includes a first opening 308*a* defined therein (actually, in this example structure 300, the arch portion 304 includes three openings 308*a* defined therein). Of course, any number of openings 308*a* in the arch area 304 may be provided without departing from this invention.

In at least some examples of this invention, the openings 308*a* in the arch portion 304 may be quite large, e.g., so as to allow a high volume of gaseous exchange between the interior portions of the footwear structure and the exterior environment. For example, as shown in FIGS. 3 and 4, if desired, at least one of the openings 308*a* in the arch portion 304 of the midsole structure 300 may extend uninterrupted in substantially a longitudinal direction of the midsole structure 300 (e.g., in a forefoot to rear foot direction D) for at least one inch, and in some examples one or more openings 308*a* will extend uninterrupted in the longitudinal direction D for at least one and one half inches, or two inches or even more (e.g., depending, at least in part, on the overall shoe size for which the midsole member 300 is designed). In this illustrated example, each of at least some portion of the three openings 308*a* extends uninterrupted in the longitudinal direction D for about inch or more. Additionally, if desired, at least one of the openings 308*a* may extend uninterrupted in a direction transverse to the longitudinal direction D (e.g., from a medial side toward a lateral side of the midsole structure 300) for at least ¼ inch, and in some instances, for at least ½ inch or more. Of course, any size, shape, and/or number of openings 308*a* may be provided in the arch portion 304 of a midsole structure 300 without departing from at least some examples of this invention.

The arch portion 304 is not the only portion of the midsole member structure 300 that may include openings defined therein. For example, as shown in FIGS. 3 and 4, the forefoot portion 302 of this example midsole structure 300 includes a plurality of openings 310 defined therein. While, again, any size, shape, and/or number of openings 310 may be provided in the forefoot portion 302 of a midsole structure 300 without departing from this invention, in this illustrated example, the forefoot openings 310 are relatively small round openings provided in a matrix pattern extending essentially down the center of the forefoot portion 302 in the longitudinal direction D. The plural openings 310 in the forefoot portion 302 of the midsole member 300, at least in this example structure 300, are independent of the various openings 308*a* defined in the arch portion 304. In other structures, if desired, one or more of the openings 310 provided in the forefoot portion 302 (if any) may be interconnected with one or more of the openings 308*a* provided in the arch portion 304 of the midsole member 300. Of course, if desired, one or more openings of various different sizes and shapes also may be provided in the rearfoot portion 306 of the midsole structure 300 without departing from this invention.

Because of the various openings in the midsole member structure 300 (e.g., openings 308*a*, 310, etc.), footwear products that include such a midsole member 300 may exhibit excellent gas exchange between the footwear interior and the exterior environment. While a very open midsole structure 300 of this type may be suitable for indoor use or use in very dry or arid conditions, this very open midsole structure 300 also could be expected to allow entry of substantial moisture from external sources into the footwear structure, if any exterior moisture is present (e.g., from rain, snow, dew, irrigation, etc.). Accordingly, midsole structures in accordance with at least some examples of this invention may include structures to help reduce or eliminate the introduction of external moisture into a footwear structure through the various openings provided in a midsole, while still providing a comfortable and breathable midsole structure. This balance may be accomplished, in accordance with at least some examples of this invention, by providing a breathable membrane 312 to at least partially cover the plural openings 310 in the forefoot portion 302 of the midsole member 300. As shown in FIGS. 3 and 4, the breathable membrane 312 may be shaped and positioned so as to cover all but a few openings 310 in the forefoot portion 302 of the midsole member 300. Of course, any number of the openings 310 may be covered and/or, if desired, all of the openings 310 may be covered using one or more breathable membranes 312 without departing from this invention.

The breathable membrane 312 may be made of any suitable or desired natural, polymer, fabric, or other material without departing from the invention, including conventional materials known and used in the footwear art. As one more specific example, the breathable membrane 312 may be made from GORE-TEX® (commercially available material from W.L. Gore & Associates), SYMPATEX® (commercially available from Sympatex Technologies GmbH of Wuppertal, Germany), or other similar materials. Of course, the breathable membrane 312 may be made from multiple pieces separately applied to various areas of the forefoot portion 312 of the midsole member 300 without departing from this invention.

Figure 5:
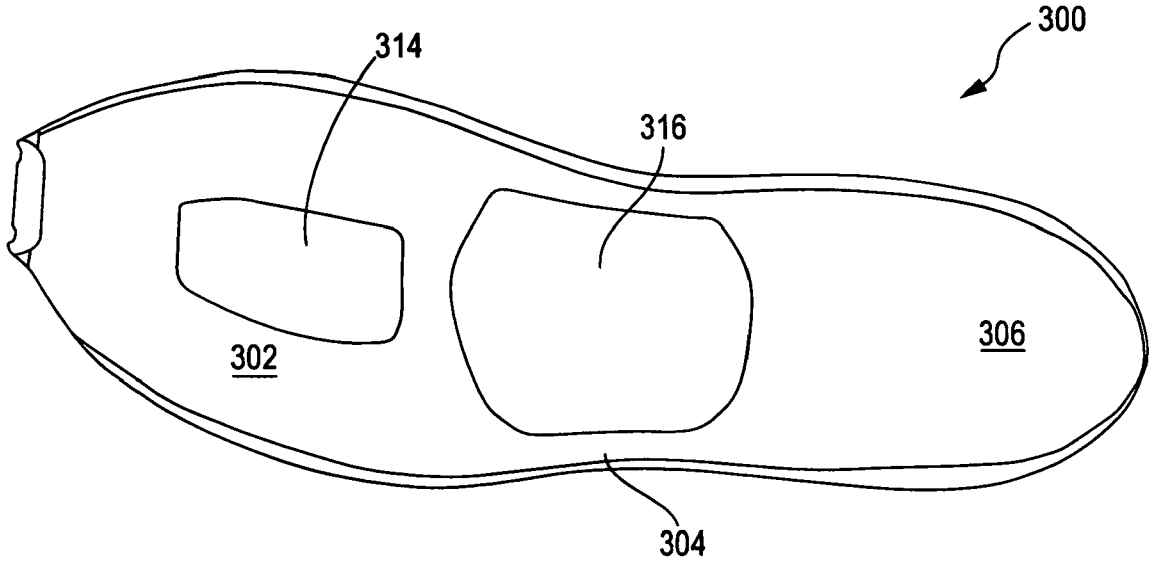
FIG. 5 illustrates an interior or "foot-side" view of a midsole member useful in sole structures in accordance with at least some examples of this invention in which the midsole member includes breathable membranes over at least some openings.

Additionally, if desired, one or more pieces of breathable membrane material may be engaged with the midsole member 300 to at least partially cover one or more of the larger openings 308*a* provided in the arch region 304 of the midsole structure 300 (and thereby further improve the water resistance and/or watertightness characteristics of the midsole member 300). FIG. 5 illustrates an example midsole structure 300 in which all or substantially all of the openings in the forefoot portion 302 and the large openings 308*a* in the arch portion 304 of the midsole structure 300 are covered with pieces of breathable membrane material 314 and 316, respectively. While the breathable materials 312, 314, and 316 in FIGS. 3 and 5 are shown on the interior-most surface of their respective midsole structures 300 (i.e., the surface closest to the wearer's foot), this is not a requirement. Rather, if desired, one or more of the breathable material pieces 312, 314, and/or 316 may be provided on the opposite side of the midsole structure 300 from that shown in the figures (i.e., away from the foot) without departing from this invention. Also, the breathable membrane materials 312, 314, and/or 316 may be fixed or held to the midsole structure 300 (and/or other portions of an overall sole or shoe structure) in any suitable or desired manner without departing from this invention, including through the use of cements, adhesives, seal structures, retaining elements, mechanical connectors, or the like, including through the use of conventional connection techniques known and used in the art.

Figure 6:
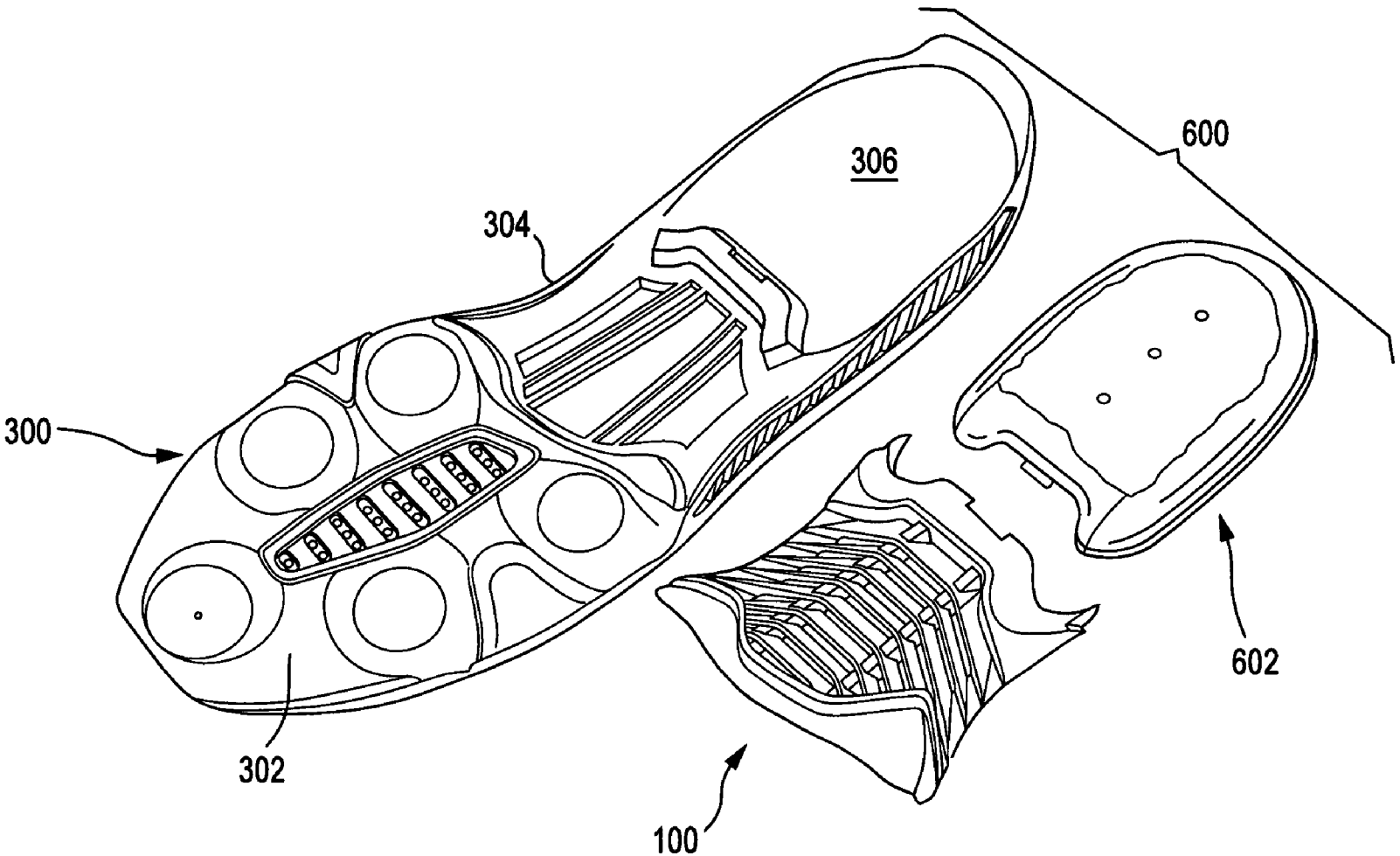
FIG. 6 illustrates various parts of a sole structure in accordance with at least some examples of this invention, including a fluid-filled bladder, a sole plate, and a midsole assembly, prior to assembly.

Sole structures in accordance with at least some examples of this invention may include various combinations or assemblages of independent parts or pieces. FIG. 6 illustrates an example of various parts that may make up a sole structure 600 or a portion of an overall sole structure 600 in accordance with at least some examples of this invention. Specifically, this sole structure combination 600 includes a midsole member 300 (e.g., like those illustrated and described above in conjunction with FIGS. 3-5) and a sole plate 100 (e.g., like that illustrated and described above in conjunction with FIGS. 1 and 2). In FIG. 6, the exterior-most surface of the midsole member 300 (i.e., the surface shown in FIG. 4) is shown, and this surface is shaped in its arch portion 304 (e.g., during its molding or during another manufacturing step) to receive and/or connect with the interior-most surface of the sole plate 100 (i.e., the surface shown in FIG. 1). If desired, the adjacent structures (e.g., edges and surfaces) of the midsole member 300 and the sole plate 100 may include complementary grooves, openings, raised ribs, and/or other structures so as to allow the various parts to securely fit together and remain in place with respect to one another (see FIG. 7). These parts 100 and 300 may be held together in any suitable or desired manner without departing from the invention, including through the use of adhesives, cements, retaining elements, mechanical connectors, and/or other ways, including conventional ways known and used in the art.

While the ribs of the sole plate 100 are shown oriented to extend substantially transverse across the midsole member 300 in the illustrated example (e.g., from the medial side toward the lateral side), other orientations may be used without departing from the invention. For example, the ribs of the sole plate 100 may be arranged to extend in the longitudinal direction of the midsole member 300, to extend in a diagonal direction with respect to the midsole member's longitudinal direction, to extend in two or more different directions (e.g., orthogonally, etc.), etc. Other rib orientations or arrangements also are possible without departing from this invention. Also, as noted above, the sole plate 100 may be constructed from multiple independent pieces separately attached to the midsole member 300 without departing from this invention.

The sole structure 600 of FIG. 6 also includes an impact-attenuating element that, at least partially, attenuates ground reaction forces. While any type of impact-attenuating element may be used without departing from this invention, in the illustrated example of FIG. 6, the impact-attenuating element is a fluid-filled bladder 602. Such bladders 602 are known and used in the art, e.g., filled with air or other gas in a gas-tight envelope to provide a lightweight and effective impact-attenuating structure. In this illustrated example, the bladder 602 fits into a corresponding recess provided in the heel or rearfoot portion 306 of the midsole member 300 (see FIG. 7). The bladder 602 (or other impact-attenuating element) may be included as part of an overall sole structure 600 and/or fixed with the midsole member 300 in any suitable or desired manner without departing from the invention, including through the use of adhesives, cements, retaining elements, mechanical connectors, and/or other ways, including conventional ways known and used in the art.

Of course, if desired, other types of impact-attenuating elements and/or impact-attenuating materials may be used without departing from the invention, such as foam rubber or polymeric materials, optionally in a column or cylindrical shape, made from other suitable materials, including spring members, etc. In some examples, impact-attenuating elements of the type used in footwear available from NIKE, Inc. of Beaverton, Oreg. under the SHOX™ brand may be included in sole and/or footwear structures in accordance with the invention. As another alternative, in at least some examples of this invention, no separate impact-attenuating element is required, e.g., the rearfoot portion 306 of the midsole member 300 may be sized, shaped, and constructed from suitable materials so as to provide adequate levels of impact-attenuation. As still additional examples, if desired, additional impact-attenuating material(s) and/or other elements may be provided in other portions of the midsole member structure 300, including in the forefoot portion 302.

Figure 7:
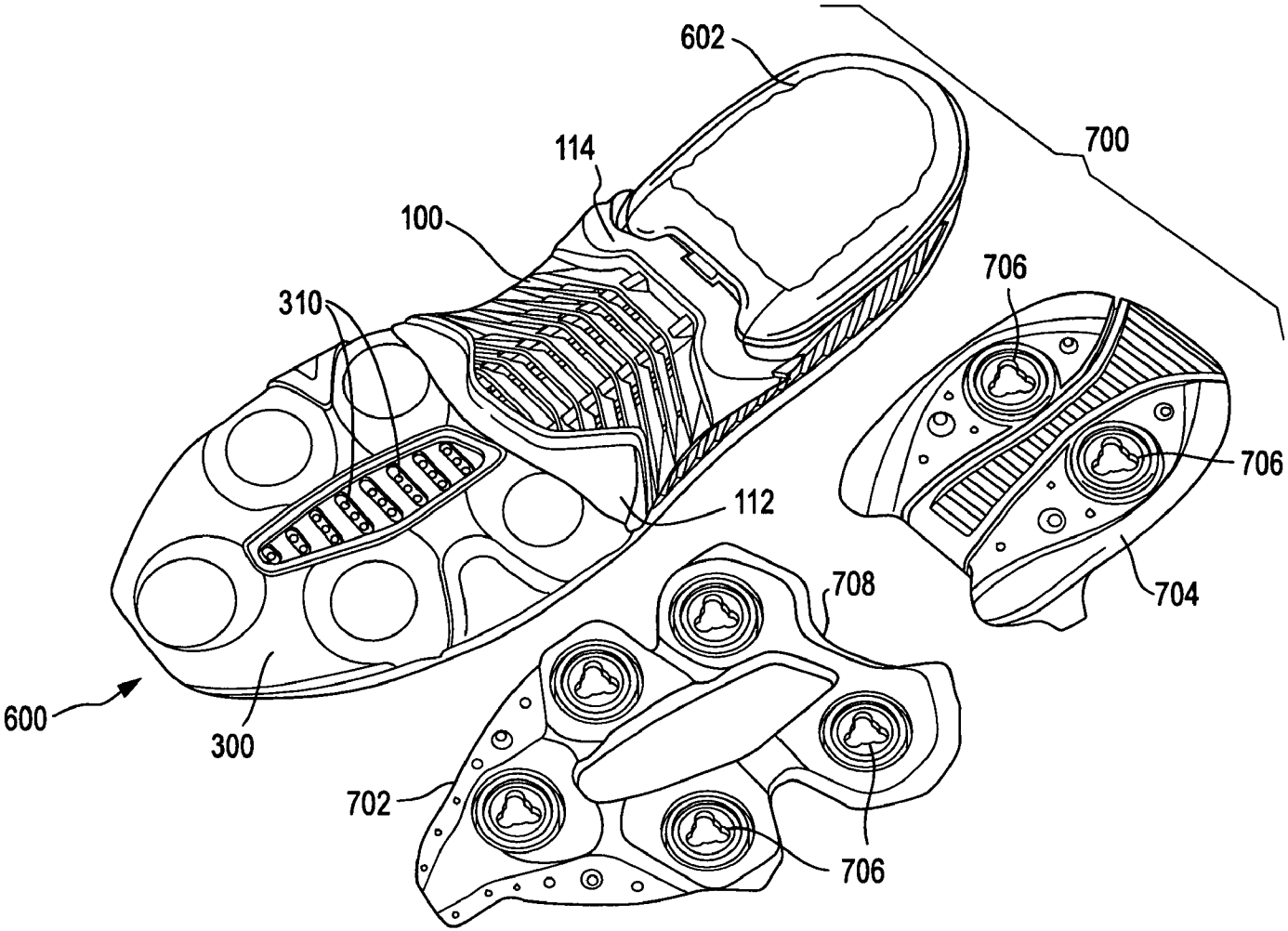
FIG. 7 illustrates various parts of a sole structure in accordance with at least some examples of this invention, including the assembled sole structure of FIG. 6 and additional outsole members, prior to assembly.

FIG. 7 illustrates another sole structure 700 combination or assemblage in accordance with at least some examples of this invention. The assembled sole structure 600 combination from FIG. 6 serves as a starting point for the combination sole structure 700 in FIG. 7. More specifically, as shown, the sole structure 600 includes the midsole member 300 with the sole plate 100 attached at the arch portion of the midsole member 300 and a fluid-filled bladder 602 attached at the heel or rearfoot portion of the midsole member 300. Also, if desired, the front of the fluid-filled bladder structure 602 may overlay and/or engage the flange 114 provided along the edge of the sole plate 100 to help secure the sole plate 100 in place. Additionally, in the sole structure 700 of FIG. 7, outsole members 702 and 704 also are added to the overall sole structure 700. Of course, any number of outsole members (including one) may be provided in an overall sole structure 700 without departing from the invention (or alternatively, if desired, at least some portions of the bottom-most surface of the midsole member 300 may be made from materials suitable for use directly as the outsole member or a portion thereof. In this illustrated example, two independent outsole members 702 and 704 are provided, one for the forefoot portion of the midsole member 300 (outsole member 702) and one for the rearfoot portion of the midsole member 300 (outsole member 704). The rearfoot outsole member 704 of this example structure attaches over the fluid-filled bladder 602 such that the bladder 602 is sandwiched between the outsole member 704 and the midsole member 300. The final assembled sole structure 700 of this example is shown in FIG. 9.

The various outsole member(s) may be made from any desired material and/or in any desired manner without departing from the invention, including from conventional materials and in conventional manners known and used in the art. For example, the exterior-most surface of the outsole members 702 and/or 704 may be formed from a polymeric material having traction elements (e.g., cleats, spikes, etc.) and/or sufficient wear and abrasion resistance to directly contact the ground or other surface in use. The exterior-most surface of the outsole members 702 and/or 704 also may include attachment systems for traction elements and/or other structures suitable for the type of shoe to be provided. For example, in the illustrated example structure, the exterior-most surface of the outsole member(s) 702 and/or 704 includes receptacles 706 for receiving spike elements for golf shoes. Such receptacles 706 may be of any desired structure or construction, including conventional structures or constructions that are known and used in the art.

The outsole member(s) 702 and/or 704 also may be attached to the remainder of the sole structure 600 in any desired manner without departing from the invention, including through the use of adhesives, cements, stitching, sewing, retaining elements, mechanical connections, and/or conventional ways known and used in the art. To help better hold the outsole member(s) 702 and/or 704 in place in the final sole structure 700, the interior-most surface of the outsole member (s) 702 and/or 704 may include openings, grooves, raised ribs, and/or other elements that fit into complementary openings, grooves, raised ribs, and/or other elements provided in the midsole member 300, the sole plate 100, and/or the fluid-filled bladder structure 602. Additionally, if desired, portions of outsole member 702 may cover and/or otherwise engage engagement flange 112 provided on the sole plate 100, and/or portions of outsole member 704 may cover and/or otherwise engage engagement flange 114 provided on the sole plate 100. In this manner, attachment of the outsole members 702 and/or 704 to the midsole member 300, the sole plate 100, and/or the fluid-filled bladder 602 can help hold the sole plate 100 in place in the overall sole structure 700. As noted above, the final assembled sole structure 700 of this example is shown in FIG. 9.

Figure 8:
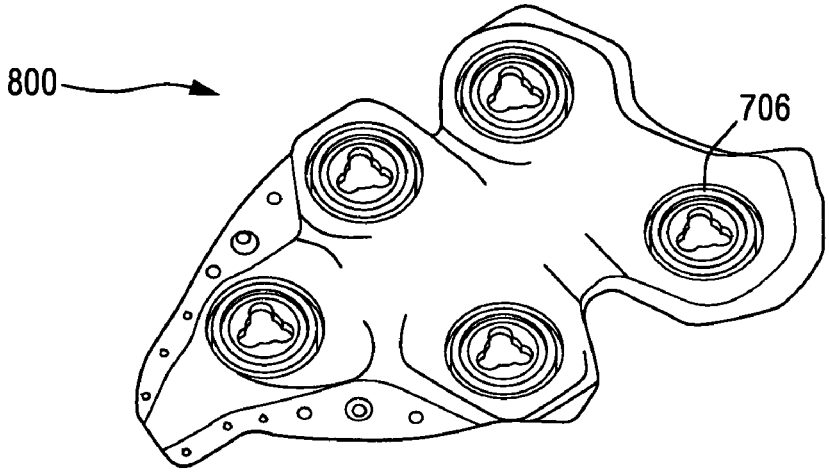
FIG. 8 illustrates another example outsole member for a forefoot portion of an article of footwear that may be used in accordance with at least some examples of this invention.
Figure 9:
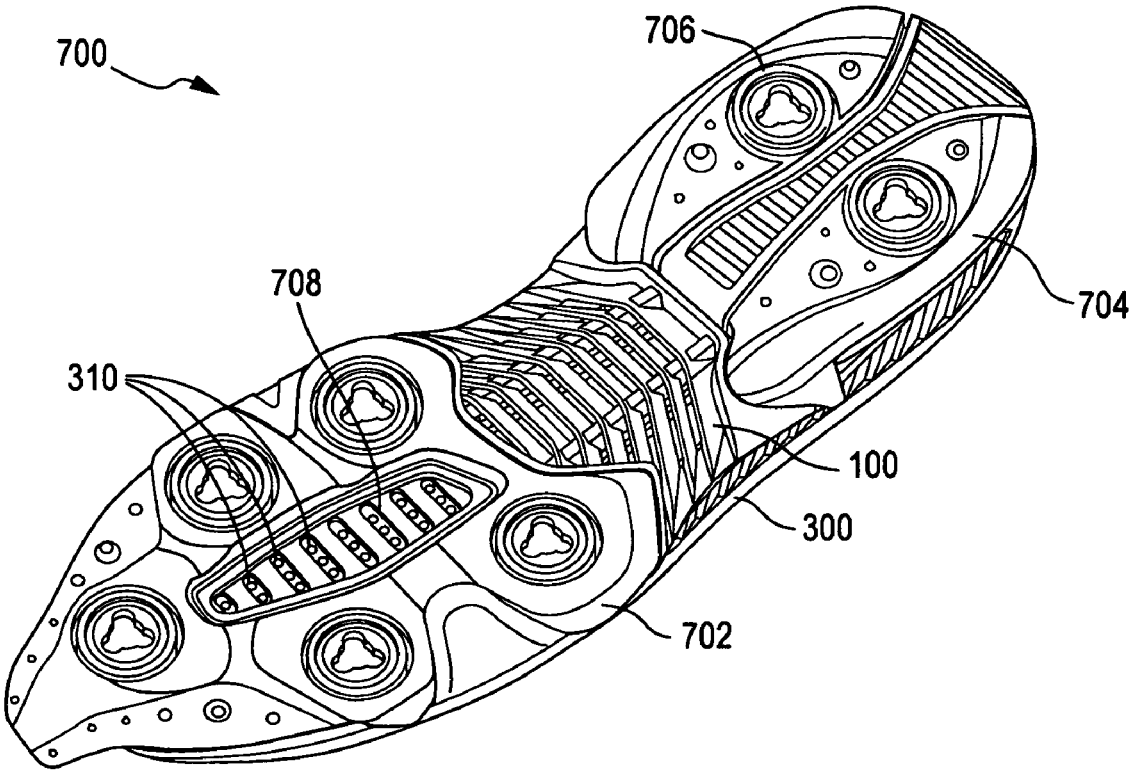
FIG. 9 illustrates an exterior side view of an assembled sole structure in accordance with at least some examples of this invention.

Another feature available in at least some example sole structures, like structure 700 shown in FIGS. 7 and 9, includes one or more openings 708 provided in the outsole member 702 at the forefoot portion of the sole structure 700. The opening(s) 708 is (are) provided in an area of the outsole member 702 corresponding to the one or more of the openings 310 provided in the forefoot portion of the midsole member 300. Alternatively, if desired, as shown in FIG. 8, an outsole member 800 for the forefoot portion of a sole structure need not include an opening 708 of the type shown in FIG. 9. Rather, if desired, a closed outsole member structure 800 may be provided (as shown in FIG. 8), and optionally, air or other materials expelled from the interior of a footwear structure via openings 310 in the midsole structure 300 may be vented from the sole structure 700 in another location, such as through vent openings provided in the side or bottom of the sole structure 700, between the midsole member 300 and the outsole member 800 and/or the sole plate 100, or the like.

Figure 10:
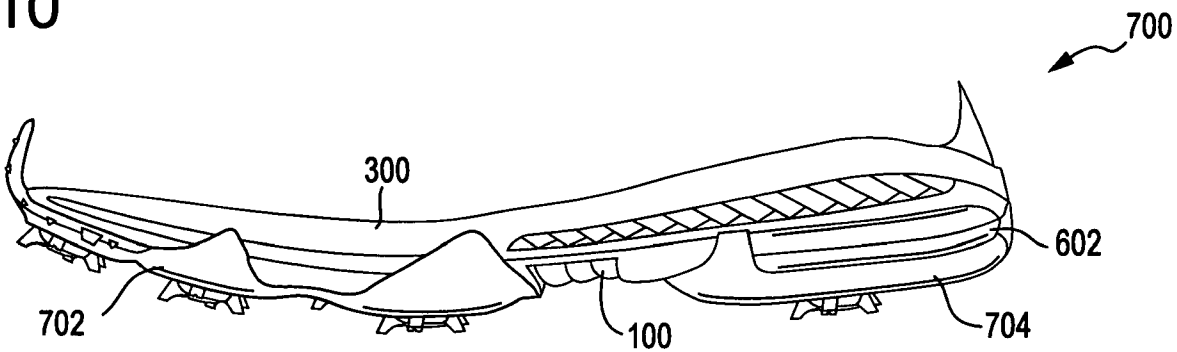
FIG. 10 illustrates a side view of an assembled sole structure in accordance with at least some examples of this invention.

FIG. 10 illustrates a side view of the sole structure 700 of FIG. 9, e.g., in a form ready for inclusion in an article of footwear, such as in an article of athletic footwear. As shown and described above, this example sole structure 700 includes midsole member 300 with outsole member 702, sole plate 100, and fluid-filled bladder 602 attached to its bottom surface. As shown in FIG. 10, fluid-filled bladder 602 is sandwiched between the midsole member 300 and the outsole member 704 in this example structure.

Figure 11:
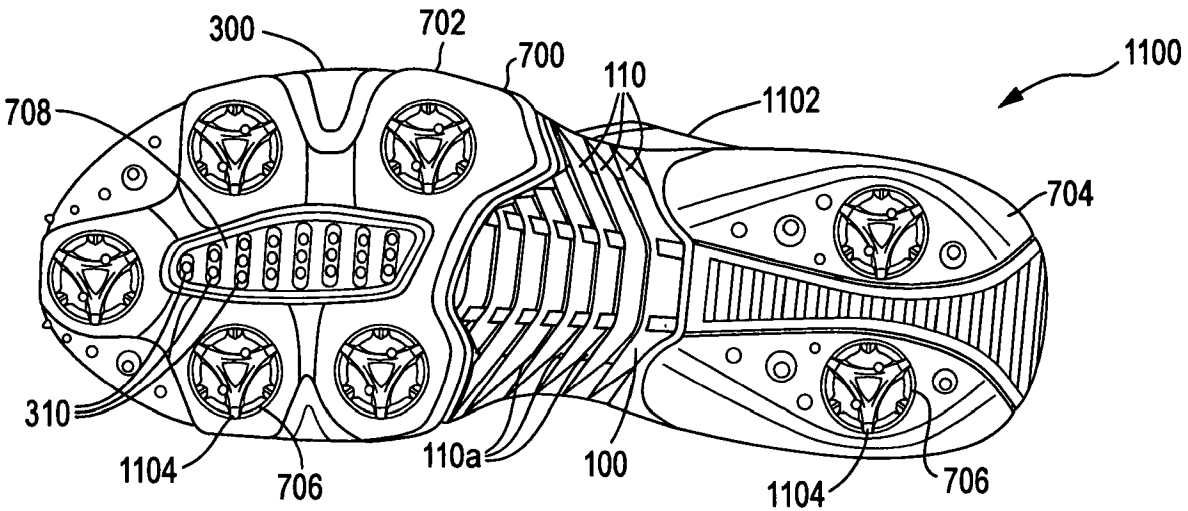
FIG. 11 illustrates an exterior side view of an article of footwear in accordance with at least some examples of this invention wherein air exchange openings in the exterior bottom of the sole structure are visible.
Figure 12:
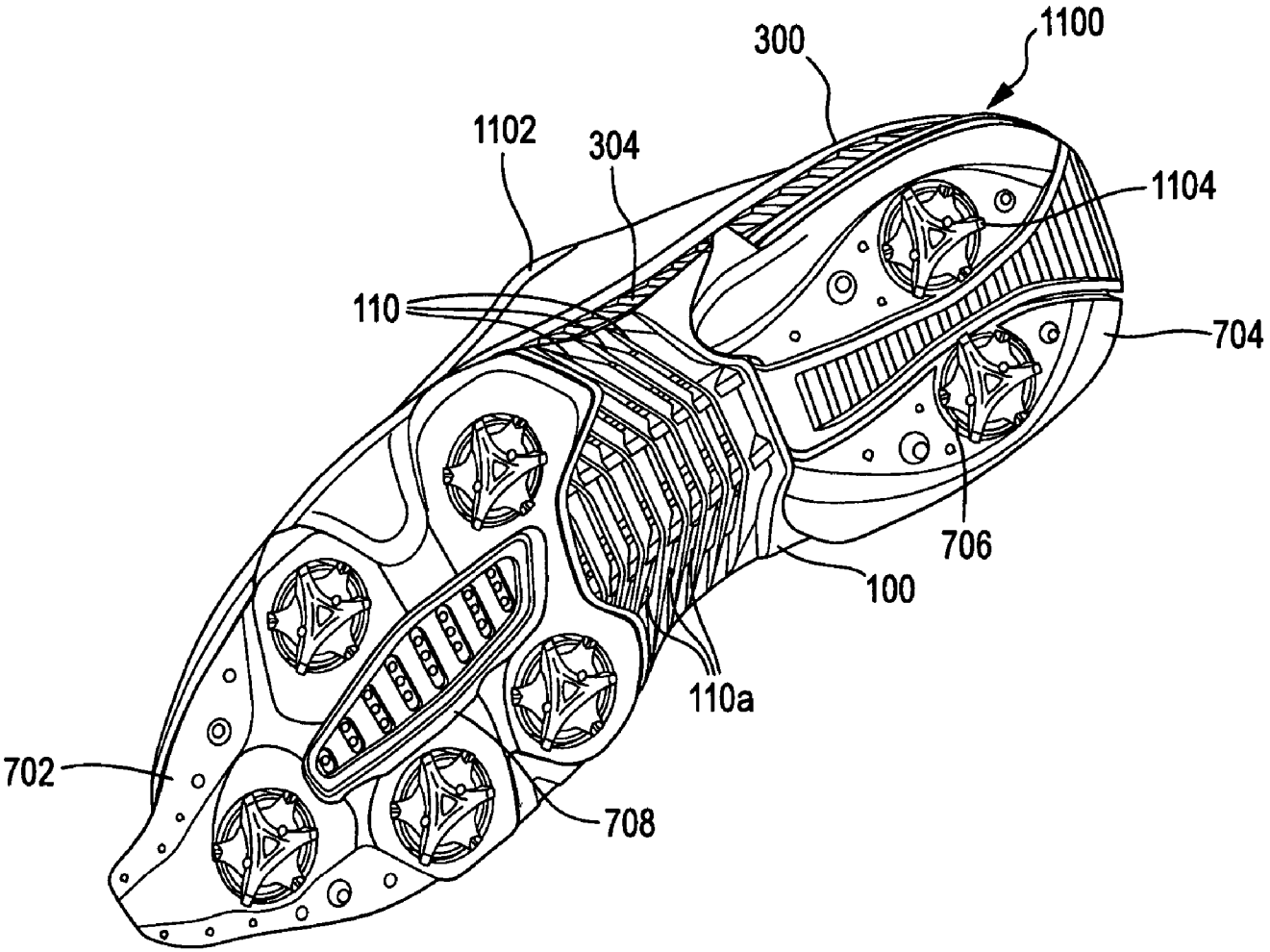
FIG. 12 illustrates a perspective view of an article of footwear in accordance with at least some examples of this invention wherein air exchange openings in the exterior bottom of the sole structure are visible.
Figure 13:
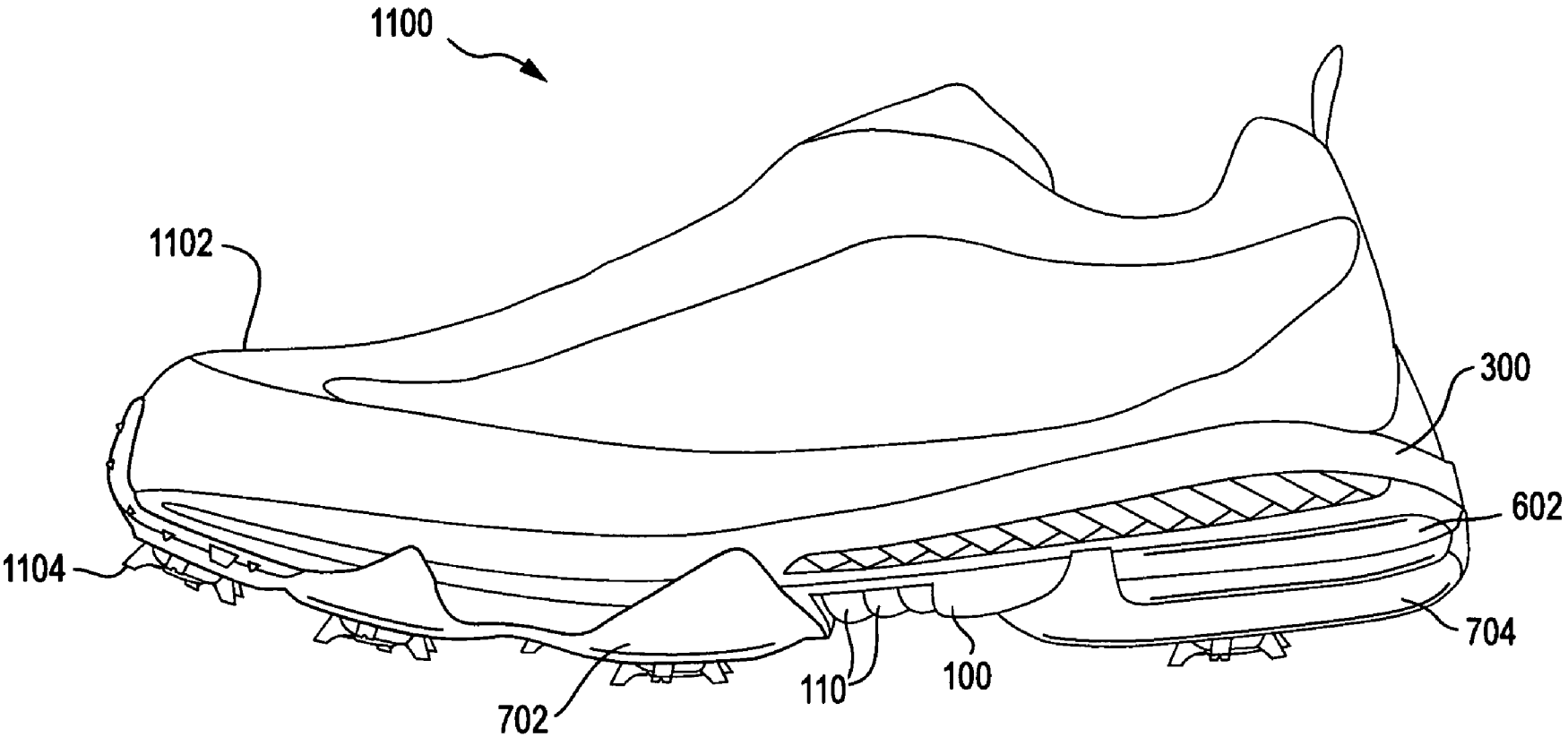
FIG. 13 illustrates a side view of an article of footwear in accordance with at least some examples of this invention.

FIGS. 11-13 illustrate various views of an example final assembled article of footwear 1100 in accordance with one example of this invention. The article of footwear 1100 (a golf shoe in this example) includes an upper member 1102 engaged with a sole structure 700, like the sole structure 700 illustrated and described above in conjunction with FIGS. 1-10. The upper member 1102 and the sole structure 700 may be engaged together in any suitable or desired manner, such as via cements, adhesives, sewing, stitching, mechanical connectors, retaining elements, or the like, including in conventional manners known and used in the art. The upper member 1102 and the sole structure 700 together form a chamber for receiving a wearer's foot. As shown in these figures, the footwear structure 1100 of this example includes traction element receptacles 706, and these receptacles have golf spikes 1104 engaged therein.

As best shown in FIGS. 11 and 12, the sole plate 100 provided at the arch portion 304 of the midsole member 300 includes its plural rib members 110 extending in substantially a transverse direction across the sole structure 700 (e.g., generally from the medial side of the footwear structure 1100 to the lateral side—as generally noted above, however, these ribs 110 (and their corresponding adjacent openings **110*a* may extend in other directions without departing from this invention). The rib members 110, as described above, define slat openings 110*a* therebetween. The slat openings 110*a* are provided adjacent the large openings 308*a* in the midsole member 300 (e.g., optionally covered by a breathable membrane 316, as described above) to provide excellent breathability and ventilation to the overall footwear structure 1100. As also shown in FIGS. 11 and 12, vent openings 310 and outsole member opening 708 provide further breathability and ventilation to the overall footwear 1100 and/or sole structure 700**.

While aspects of the invention have been described in detail above in connection with drawings that illustrate aspects of the invention as they relate to articles of footwear, those skilled in the art will recognize that aspects of this invention may be extended to use with other foot-receiving devices, such as bindings, clips, housings, and the like for engaging users' feet with skis, snowboards, pedals, exercise equipment, video games or other games, and the like. In general, without departing from this invention, the more general term "foot-receiving device" may be substituted for the terms "footwear" and/or "shoe" or the like in the above description, the more general term "foot-covering member" may be substituted for the terms "upper" and/or "upper member" or the like in the above description, the more general term "foot-supporting member" may be substituted for the terms "sole members" and/or "sole structures" or the like in the above description, and the more general terms "ground-contacting elements" and/or "ground-contacting members" may be substituted for the terms "outsole" and/or "outsole member" or the like in the above description.

D. Conclusion

While the invention has been described with respect to specific examples including presently preferred modes of carrying out the invention, those skilled in the art will appreciate that there are numerous variations, combinations, and permutations of the above described structures. Moreover, various specific structural features included in the examples merely represent examples of structural features that may be included in some examples of structures according to the invention. Those skilled in the art will understand that various specific structural features may be omitted and/or modified in a footwear or other foot-receiving device product without departing from the invention. Thus, the reader should understand that the spirit and scope of the invention should be construed broadly as set forth in the appended claims.

We claim:

1. A sole structure for footwear, comprising:

a midsole member, wherein at least an arch portion of the midsole member includes a first opening defined therein;

a sole plate engaged with the midsole member at the arch portion, wherein the sole plate at least substantially covers the first opening, and wherein the sole plate includes plural rib elements that thereby define plural slat openings in the sole plate that extend between adjacent rib elements; and a first outsole member engaged with the midsole member for providing a ground-contacting surface, wherein a forefoot portion of the midsole member includes plural openings defined therein which are independent of the first opening, wherein the first outsole member is engaged with the midsole member at a forefoot portion of the sole structure, and wherein the first outsole member at least partially covers the plural openings in the forefoot portion of the midsole member.

2. A sole structure according to claim 1, wherein the first opening extends uninterrupted in substantially a longitudinal direction of the sole structure for at least one inch.

3. A sole structure according to claim 1, wherein the arch portion of the midsole member further includes a second opening defined therein, wherein each of the first and second openings extends uninterrupted in substantially a longitudinal direction of the sole structure for at least one inch.

4. A sole structure according to claim 1, further comprising:

a fluid-filled bladder element provided between the midsole member and the first outsole member.

5. A sole structure according to claim 1, wherein the first outsole member engages a forefoot portion of the sole plate.

6. A sole structure according to claim 1, further comprising:

a breathable membrane engaged with the midsole member, wherein the breathable membrane at least substantially covers the first opening.

7. A sole structure according to claim 1, wherein the first outsole member is engaged with the midsole member at a forefoot portion of the sole structure, and wherein the sole structure further includes:

a second outsole member engaged with the midsole member at a rearfoot portion of the sole structure.

8. A sole structure according to claim 7, further comprising:

a fluid-filled bladder element provided between the midsole member and the second outsole member.

9. A sole structure according to claim 7, wherein the first outsole member engages a forefoot portion of the sole plate and the second outsole member engages a rearfoot portion of the sole plate.

10. A sole structure according to claim 1, wherein the sole plate includes a first engagement flange extending toward a forefoot portion of the sole structure and a second engagement flange extending toward a rearfoot portion of the sole structure.

11. A sole plate according to claim 1, wherein the sole plate includes: (a) a first reinforcing rib extending between at least some of the plural rib elements and thereby extending across at least some of the plural slat openings and (b) a second reinforcing rib independent of the first reinforcing rib and extending between at least some of the plural rib elements and thereby extending across at least some of the plural slat openings.

12. A sole structure for footwear, comprising:

a midsole member, wherein at least an arch portion of the midsole member includes a first opening and a second opening defined therein, wherein each of the first and second openings extends uninterrupted in a longitudinal direction of the sole structure for at least one inch;

a sole plate engaged with the midsole member at the arch portion, wherein the sole plate at least substantially covers the first and second openings, and wherein the sole plate includes plural rib elements extending in substantially a transverse direction of the sole structure to thereby define plural slat openings in the sole plate that extend between adjacent rib elements;

a first outsole member engaged with the midsole member at a forefoot portion of the sole structure; and a second outsole member engaged with the midsole member at a rearfoot portion of the sole structure, wherein a forefoot portion of the midsole member includes plural openings defined therein, wherein the plural openings are independent of the first and second openings defined in the arch portion, wherein the first outsole member at least partially covers the plural openings in the forefoot portion of the midsole member.

13. A sole structure for footwear according to claim 12, further comprising:

vent openings provided in the side of the sole structure, wherein air or other materials expelled via the plural openings defined in the forefoot portion of the midsole member are vented through the vent openings in the side of the sole structure.

14. A sole structure according to claim 12, further comprising:

a breathable membrane engaged with the midsole member, wherein the breathable member at least partially covers the plural openings in the forefoot portion of the midsole member.

15. A sole structure according to claim 12, further comprising:

a fluid-filled bladder element provided between the midsole member and the second outsole member.

16. A sole structure according to claim 12, further comprising:

one or more breathable membranes engaged with the midsole member, wherein the breathable membrane or membranes at least substantially cover the first and second openings.

17. A sole structure according to claim 12, wherein the first outsole member engages a forefoot portion of the sole plate and the second outsole member engages a rearfoot portion of the sole plate.

18. A sole structure according to claim 12, wherein the sole plate includes a first engagement flange extending toward a forefoot portion of the sole structure and a second engagement flange extending toward a rearfoot portion of the sole structure.

19. A sole plate according to claim 12, wherein the sole plate includes: (a) a first reinforcing rib extending between at least some of the plural rib elements and thereby extending across at least some of the plural slat openings and (b) a second reinforcing rib independent of the first reinforcing rib and extending between at least some of the plural rib elements and thereby extending across at least some of the plural slat openings.

20. A sole structure for footwear according to claim 1, further comprising:

vent openings provided in the side of the sole structure, wherein air or other materials expelled via the plural openings defined in the forefoot portion of the midsole member are vented through the vent openings in the side of the sole structure.

21. A sole structure according to claim 1, further comprising:

a breathable membrane engaged with the midsole member, wherein the breathable member at least partially covers the plural openings in the forefoot portion of the midsole member.

* * * * *